US006004056A

United States Patent [19]

De Laforcade

[11] Patent Number: 6,004,056

[45] Date of Patent: Dec. 21, 1999

[54] UNIT FOR DISPENSING A FLUID PRODUCT

[75] Inventor: Vincent De Laforcade, Rambouillet, France

[73] Assignee: L'Oreal, Paris, France

[21] Appl. No.: 08/962,775

[22] Filed: Nov. 3, 1997

Related U.S. Application Data

[63] Continuation of application No. 08/423,858, Apr. 18, 1995, abandoned.

[30] Foreign Application Priority Data

Apr. 18, 1994 [FR] France ..... 94 04601

[51] Int. Cl.[6] ..... A45D 34/00

[52] U.S. Cl. ..... 401/190; 401/88; 222/402.13

[58] Field of Search ..... 401/88, 190, 206; 222/402.13; 239/337

[56] References Cited

U.S. PATENT DOCUMENTS

| | | | |
|---|---|---|---|
| 2,996,750 | 8/1961 | Cholet | 401/206 |
| 3,282,471 | 11/1966 | Lehmann | 222/182 |
| 3,305,179 | 2/1967 | Lehmann | 239/337 |
| 3,762,611 | 10/1973 | Nigro | 222/402.13 |
| 4,277,004 | 7/1981 | Barlics . | |
| 4,461,408 | 7/1984 | Shepard | 401/206 X |
| 4,480,940 | 11/1984 | Woodruff | 401/206 |

FOREIGN PATENT DOCUMENTS

| | | | |
|---|---|---|---|
| 0 037 903 | 10/1981 | European Pat. Off. | 401/190 |
| 1 475 176 | 1/1969 | Germany . | |
| 1168278 | 10/1969 | United Kingdom . | |
| 2 198 035 | 6/1988 | United Kingdom | 401/190 |

*Primary Examiner*—Steven A. Bratlie
*Attorney, Agent, or Firm*—Young & Thompson

[57] ABSTRACT

A unit for applying a product, in particular a cosmetic product, has an axis of symmetry (A), a movable part (110) provided with an applicator element for applying the product, a hollow fixed part (107), and flexible elements for connecting the movable and fixed parts. The movable part is capable for displacement along the axis (A). The connecting elements are constituted by at least one tongue (111) oriented in a plane substantially orthogonal to the axis (A). A first end (111*a*) of the tongue is joined to the movable part, a second end (111*b*) of this tongue is joined to the fixed part, and the dispensing of this product is effected via the movable part.

12 Claims, 2 Drawing Sheets

UNIT FOR DISPENSING A FLUID PRODUCT

This application is a continuation of application Ser. No. 08/423,858, filed Apr. 18, 1995 now abandoned.

FIELD OF THE INVENTION

The present invention relates to an applicator unit for applying a liquid or a solid to pasty product, to a surface to be treated.

Amongst the products that can be applied by means of such a unit, there may be cited by way of example the cosmetic or dermopharmaceutical products such as deodorants, blushers, and insect repellants. More particularly, this applicator unit is for a body deodorant product.

BACKGROUND OF THE INVENTION

In the field of cosmetics, deodorant applicators have already been proposed, which use a liquid composition contained in a reservoir whereon is fixed a dispensing head that comprises an applicator dome made of a solid porous material. This type of applicator is described, for example, in FR-A-2 647 034. However, this device has the following drawbacks:

During application, the user feels a certain tightness on the skin.

Moreover, to ensure closing of the reservoir when the product is not being used, it is necessary to provide a relatively complicated dispensing head, which affects the cost.

Moreover for using the product, it is necessary to perform a prior action to bring the liquid into the porous dome which serves as the applicator element.

In general, this applicator is formed of several parts, and this results in a complicated assembly operation during manufacture, thereby entailing a high price.

SUMMARY OF THE INVENTION

The object of the present invention is to propose a new applicator unit which avoids the above mentioned drawbacks by using a monobloc dispensing system, wherein the applicator element is connected to a fixing element by means of flexible tongues, the whole unit being molded in one piece. In particular, this unit can be made cheaply. Moreover, the user will appreciate the ease of handling of this dispenser, its suppleness of operation and, in particular, its smoothness of application. Indeed, the applicator in accordance with the invention permits a soft application of a product, such as a liquid deodorant or a depilatory, in particular to sensitive areas of the skin, for example the armpits.

A first aspect of the present invention therefore provides a unit for applying a product comprising: an axis of symmetry; a movable part provided with an element for applying the product; a hollow fixed part; and flexible means for connecting the movable and fixed parts, wherein the movable part is capable of displacement along the axis, the connecting means are constituted by at least one tongue orientated in a plane substantially orthogonal to the axis, a first end of the tongue is joined to the movable part, a second end of this tongue is joined to the fixed part, the dispensing of the product is effected via the movable part, and the movable part supports an applicator element.

An applicator unit shall be understood to mean a package containing a product, this product being applied directly to the surface to be treated, for example the skin.

According to a preferred embodiment of the invention, the dispensing unit may comprise several tongues regularly distributed between two movable and fixed parts. Advantageously, the number of tongues ranges from 2 to 12.

The use of several tongues permits a better orientation of the movable part relative to the fixed part.

Preferably, a first end of a first tongue is opposite a second end of a second tongue. In other words, the tongues are thus disposed in a staggered arrangement in one plane.

The use of these tongues makes it possible to give the applicator great suppleness or softness in operation when it is actuated.

The product to be dispensed may be volatile, liquid, pasty or solid. This product may, for instance, be a perfumed body lotion, a liquid deodorant, a liquid depilatory composition or a pasty or solid friable make-up product.

As a variant, the first end of a first tongue is in an adjacent position relative to the first end of a second tongue.

Thus there is obtained a monobloc subassembly constituted by the movable part, the fixed part and the tongues, the movable part being capable of displacement relative to the fixed part in an axial direction with a soft movement along a relatively long travel, the travel depending on the length of the tongues.

In general, the travel is approximately a third of the length of a tongue. This travel can, therefore, be adjusted according to the particular use envisaged.

This subassembly may be molded or injection molded from a thermoplastic material. Preferably, the thermoplastic material is polypropylene or polyethylene. However, this subassembly may instead be made of metal or of a soft alloy of metals.

According to another variant of the present invention, the tongues may comprise at least one zone emerging from the plane occupied by the tongues. This tongue may take the shape of a single meander or have a sinusoidal shape.

During the application, this shape allows a considerable elongation of the tongues to be obtained, which is reflected in a maximum travel of the movable part.

In a first embodiment, the dispensing unit may, moreover, comprise a reservoir wherein the product to be dispensed is accommodated, the fixed part being mounted on the reservoir. In this case, the reservoir may be a reservoir that is pressurized by means of a propellant gas provided with a dispensing valve capable of causing the reservoir to communicate with the applicator element when the movable part undergoes an axial displacement in the direction towards the reservoir to produce this communication.

In this embodiment, the applicator element is constituted by a feeder duct connected to a porous dispensing dome joined to the movable part, the latter serving as support for the dome. It will be appreciated that a pressure exerted on the dome when the latter is applied to the surface to be treated will actuate the dispensing valve and thus cause the product to be dispensed through the dispensing dome. This arrangement ensures an easier use than that of the deodorant described in the document FR-A-2 647 034.

When the product is a liquid product packaged under pressure in accordance with this embodiment, this product is advantageously a composition with a cosmetic and/or dermatological action.

In a second embodiment, the movable part serves as a support for a friable product of a pasty or solid consistency, the fixed part serving as a gripping element. Such a friable product may be a solid block of compacted make-up powder, a solid make-up foundation, or the like.

A make-up product may thus be applied to the skin of the face in a very soft manner.

Yet another aspect of the present invention provides a body deodorant constituted by a unit for applying a deodorant such as defined above, that is particularly adapted to the first embodiment.

BRIEF DESCRIPTION OF THE DRAWINGS

To render the present invention more readily understood, three embodiments, represented in the attached drawings, will now be described by way of a purely illustrative and entirely non-restrictive example. In the drawing.

DETAILED DESCRIPTION OF THE INVENTION

Figure 1:
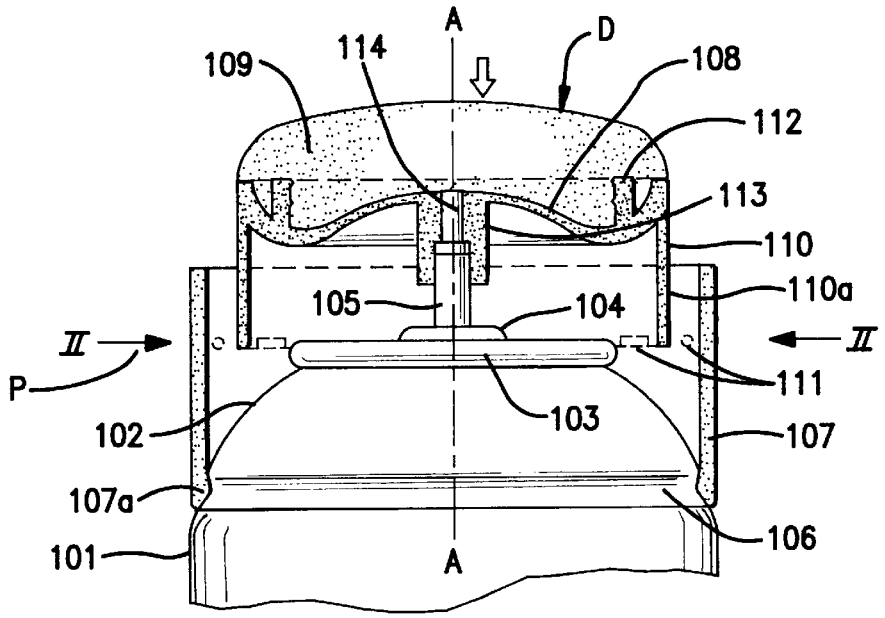
FIG. 1 shows a partial axial section of a unit for applying a liquid, in accordance with a first embodiment of the invention.

Referring to FIG. 1 there is shown a dispensing unit with an axial symmetry with axis A of a first embodiment of a body deodorant.

In FIG. 1, a cylindrical can forming a reservoir 101 for a liquid deodorant product is provided with a porous applicator dome 109 made, for example, of Porex® fixed on a convex supporting disk 108 by an annular fastening skirt 112. The support 108 is connected, over its peripheral portion on the opposite side to the skirt 112, to a cylindrical skirt 110*a*. The support-annular skirt-cylindrical skirt assembly constitutes a central part that is movable along the direction of the axis A.

The top of the reservoir 101 has the shape of an ogive 102 and has a peripheral groove 106 situated in the zone of transition between its cylindrical portion and the ogive 102. In the groove 106, there engages a peripheral catch engagement bead 107*a* which is formed, on the end turned towards the reservoir, by a cylindrical ring or fixed part 107. The ring 107 concentrically surrounds a portion of the skirt 110*a*. A set of flexible tongues 111 is disposed in the free space formed between the ring 107 and the skirt 110*a*.

At its portion facing the reservoir, the cylindrical skirt 110*a* is joined to a first end 111*a* (see FIGS. 2*a* and 2*b*) of the tongues 111. A second end 111*b* of the tongues 111 is connected to the ring 107. The tongues 111 are disposed in a plane P passing through the line II—II that is perpendicular to the axis A. The ring 107, the tongue 111, the skirt 110*a* and the support 108 constitute a monobloc subassembly that is moulded or injection-moulded in polypropylene. The support 108 has a central duct 113 capable of being engaged in a leakproof manner, a dispensing valve 104 being provided with a stem 105, this valve 104 surmounting the top 102 of the reservoir 101. On the opposite side to the reservoir 101, the duct 113 is extended in a feeder duct 114 so as to connect the stem 105 to the porous dome 109.

A liquid composition, for example a body deodorant, having a viscosity of approximately 0.003 Pa.s is stored in the reservoir 101. This liquid is pressurized by means of a conventional propellant gas.

The operation of this device is as follows. The user applies the porous dome 109 directly against the surface to be treated, by exerting slight pressure. Thanks to the flexible deformation of the tongues 111, the stem 105 of the valve 104 is depressed, producing the impregnation of the dome 109 by the liquid deodorant product via the stem 105 and the feeder duct 114. Thus the user can easily treat very sensitive zones of the body, such as the armpits, or zones that are difficult of access.

After use, the dispensing dome 109 is protected by a protective cap (not shown).

Figure 2A:
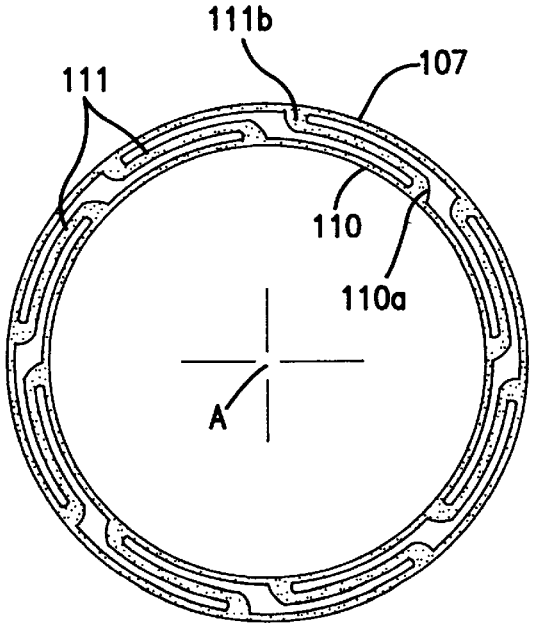
FIG. 2*a* shows a view in plane P corresponding to the section along line II—Il of FIG. 1.

FIG. 2*a* shows the plane P along the section line II—II of FIG. 1 and illustrates the arrangement of the tongues 111 which connect the movable part 110 and the fixed part 107 in a first variant of this embodiment. It will be seen that the tongues 111 have the same orientation, so that one end 111*a* of a first tongue connected to the movable part 110 is opposite the end 111*b* of a consecutive tongue connected to the peripheral part 107.

Figure 2B:
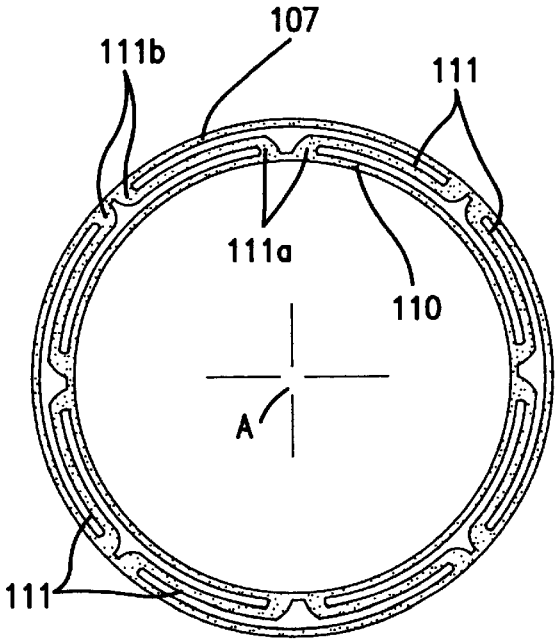
FIG. 2*b* shown a view of a variant similar to that of FIG. 2*a;*

FIG. 2*b* shows a variant of the arrangement of the tongues 111 situated in the same plane P, where two ends 111*a* of two consecutive tongues are disposed side-by-side and are connected to the central part 110, the other two ends 111*b* being disposed close to each other and attached to the peripheral part 107.

The tongues in FIGS. 2*a* and 2*b* give this device a very soft and supple operation.

The suppleness of operation of the part 110 can be adjusted by adjusting the length and thickness of the tongues.

In the case of a dispenser of a cylindrical shape, a tongue 111 may extend over an angular arc ranging from 20° to 180° in magnitude. The number of tongues is advantageously chosen from 2 to 12.

Figure 3A:
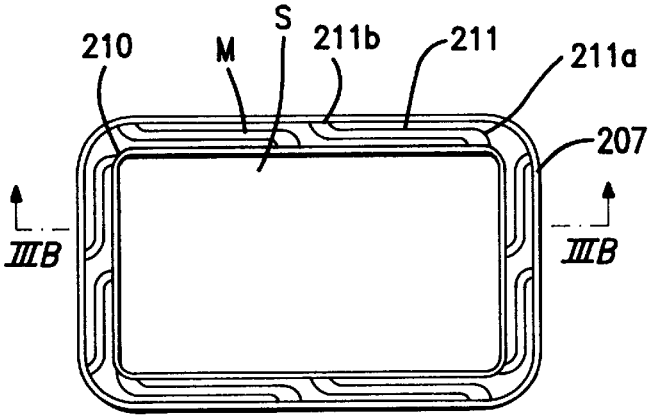
FIG. 3*a* is a top view of second embodiment of the invention comprising a solid or pasty product.
Figure 3B:
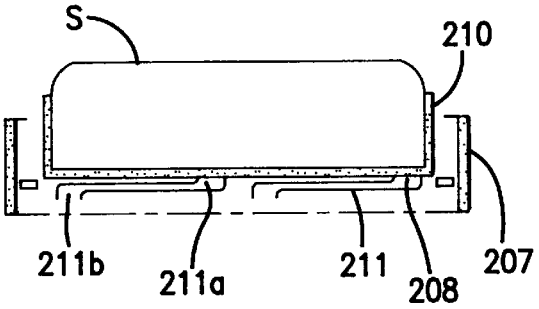
FIG. 3*b* is a sectional view along line IIIb—IIIb of FIG. 3*a;*

According to a second embodiment as shown in FIGS. 3*a* and 3*b,* a fixed part 207 with a substantially rectangular cross-section with rounded corners serves as a gripping element for a block of a solid make-up product S, for example a make-up foundation, to be directly applied to the skin. The product S is accommodated in a central cup-shaped part 210 having a bottom 208. The cup and the fixed part are concentric. At its base, the cup is connected to the end 211*a* of the tongues 211 which are in turn connected to the peripheral part 207 by their end 211*b*.

By gripping this unit by the peripheral part 207, the user applies the product S to the skin where he or she obtains a precise and wholly soft make-up, thanks to the suppleness of the tongues 211.

Figure 4A:
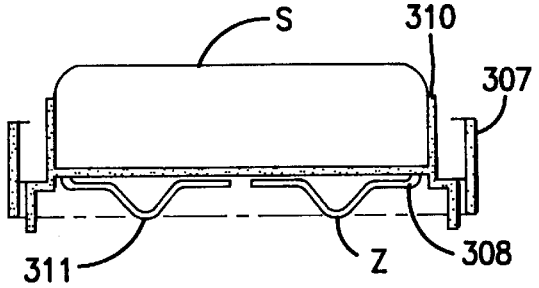
FIG. 4*a* is a longitudinal sectional view of a variant of the embodiment of the device of FIG. 3*a,* at rest.
Figure 4B:
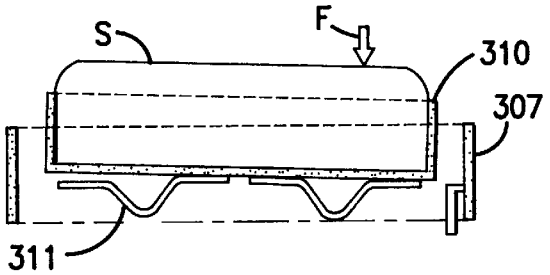
FIG. 4*b* is a longitudinal sectional view of the variant of the embodiment of the device of FIG. 3*a,* during the application.
Figure 5:
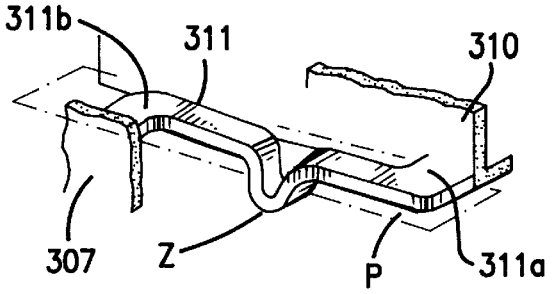
FIG. 5 is an enlarged view of a tongue in accordance with the embodiment shown in FIGS. 4*a* and 4*b*.

FIGS. 4*a* and 4*b* show a variant of the device represented in FIGS. 3*a* and 3*b*. To increase still further the softness of application, the tongues 311 connecting the central part 310 and the peripheral part 307 have been provided with a wave-shaped zone Z which is situated outside the plane P (see FIG. 5). This zone Z is preferably located approximately halfway between the ends 311*a* and 311*b*.

These wave-shaped tongues 311 impart a great softness of application (indicated by the arrow F in FIG. 4*b*) following an elongation in the opposite direction to the force applied. They may, of course, also be used in the embodiment represented in FIG. 1.

I claim:

1. A unit for applying a liquid product having one of a cosmetic and dermatological action, the unit comprising an axis of symmetry; a movable part provided with an applicator element for applying the product; a hollow fixed part; said movable part being telescopingly received within said fixed part and said applicator element extending no farther from said axis than does said movable part; flexible means for connecting the movable and fixed parts, said movable part being capable of displacement along said axis, said flexible means comprising a plurality of tongues regularly distributed between the movable part and the fixed part, and oriented in a plane substantially orthogonal to the axis, each tongue having a first and an opposite second end, the first end of each tongue being joined to the movable part, the second end of each tongue being joined to the fixed part, all the tongues extending from said first ends to said second ends in a same peripheral direction; a pressurized reservoir for storing the product, said reservoir having a dispensing valve means for causing the reservoir to communicate with the applicator element, said fixed part being mounted on said reservoir, the movable part supporting the applicator element, whereby an axial displacement of the movable part in a direction towards the reservoir produces communication between the applicator element and the reservoir for dispensing the product.

2. A unit according to claim 1, wherein the movable part, the fixed part and the plurality of tongues form a monobloc subassembly.

3. A unit according to claim 2, wherein the subassembly is molded from a thermoplastic material.

4. A unit according to claim 3, wherein the thermoplastic material is polypropylene.

5. A unit according to claim 1, wherein the number of tongues ranges from 2 to 12.

6. A cosmetic dispenser, comprising:

a cylindrical first part having an inner surface and extending in the direction of an axis from a first end to an opposite second end, said inner surface being structured and arranged at said first end for removable attachment to a liquid reservoir;

a cylindrical second part a portion of which is positioned within, and concentric with, said first part, said second part extending in said direction from one end located out of said first part to another end located within said first part, said second part having an outer surface;

a plurality of resilient tongues regularly distributed between said inner surface and said outer surface, each tongue having a first tongue end attached to said outer surface and an opposite second tongue end circumferentially spaced from said first tongue end relative to said axis and attached to said inner surface, said second part being structured and arranged so that said another end (a) can be depressed within said first part towards said first end in an active dispensing mode, and (b) resiles within said first part towards said second end in a nondispensing rest mode;

a support disc positioned within said second part and supported by an inner portion of said second part, said support disc having a first surface facing said one end and an opposite second surface facing said another end, an aperture extending through said support disc;

a duct extending in said direction from said opposite surface and being coupled with said aperture, said duct being structured and arranged for removable connection to a dispensing stem of said liquid reservoir when said first part is attached to said liquid reservoir; and a porous applicator pad contained within said second part and having an applicator surface extending from said second part at said one end and an opposite enclosing surface engaging said first surface, a portion of said opposite enclosing surface covering said aperture.

7. The dispenser according to claim 6, wherein a first tongue end of a first tongue is adjacent a second tongue end of a second tongue.

8. The dispenser according to claim 6, wherein the first part, the second part and the plurality of tongues form a monoblock subassembly.

9. The dispenser according to claim 8, wherein the subassembly is molded from a thermoplastic material.

10. The dispenser according to claim 9, wherein the thermoplastic material is polypropylene.

11. The dispenser according to claim 6, wherein the number of tongues ranges from 2 to 12.

12. The dispenser according to claim 6, wherein liquid stored in the reservoir is a liquid composition having one of a cosmetic or dermatological action.

* * * * *